United States Patent [19]

Rowton

[11] Patent Number: 4,611,739

[45] Date of Patent: Sep. 16, 1986

[54] SHEETROCK HAMMER ATTACHMENT

[75] Inventor: Danny E. Rowton, Cameron, Okla.

[73] Assignees: Henry O. Arnall; Royce J. Skelton, both of Poteau, Okla.

[21] Appl. No.: 762,680

[22] Filed: Aug. 5, 1985

[51] Int. Cl.[4] ..... B25C 1/04; B25C 7/00; B25D 7/00

[52] U.S. Cl. ..... 227/66; 227/11; 227/113; 227/142; 227/156; 227/147

[58] Field of Search ..... 227/11, 64, 66, 113, 227/130, 142, 147, 156; 83/520

[56] References Cited

U.S. PATENT DOCUMENTS

| | | | |
|---|---|---|---|
| 2,666,201 | 1/1954 | Van Orden | 227/147 |
| 3,211,039 | 10/1965 | Sheetz | 83/520 |
| 3,602,419 | 8/1971 | Doberne | 227/147 |
| 4,448,339 | 5/1984 | Pettigrew | 227/147 |
| 4,566,619 | 1/1986 | Kleinholz | 227/66 X |

*Primary Examiner*—Robert L. Spruill
*Assistant Examiner*—Taylor J. Ross
*Attorney, Agent, or Firm*—William S. Dorman

[57] ABSTRACT

A sheetrock hammer attachment used in conjunction with a pneumatic hammer operator having a rear body portion and a forward body portion, the forward body portion comprising a threaded bore having its forward end surrounded by a smooth outer sleeve and the rear body portion having an operating switch which activates the vibrating action of the hammer; comprising a hardened steel hammer having a rounded forward head and an elongated shaft extending rearwardly therefrom, the elongated shaft being received in the bore and being operationally connected thereto, a central portion of the head is drilled away to receive a non-magnetic insert containing a smaller cylindrical magnet, the magnet being provided to hold the head of a nail, a plexiglass shield covering the front end of said sleeve and extending forwardly therefrom, a tension spring rotatably affixed to the rear portion of the shield and being wound about the rear portion of the sleeve, and a rotatable nut threadedly connected to the bore adjacent the rear end of the spring for controlling the length of the spring, wherein depressing the switch activates the hammer causing the shield to reciprocate while compressing the spring thereby driving the nail into a panel of sheetrock.

5 Claims, 9 Drawing Figures

SHEETROCK HAMMER ATTACHMENT

BACKGROUND OF THE INVENTION

1. Field of the Invention

The present invention relates to an apparatus for fastening or nailing sheetrock to wooden studs. More particularly, the present invention relates to an attachment for a pneumatic hammer operator which magnetically holds the head of a nail and provides a consistent dimpling stroke into the sheetrock.

2. Prior Art

It is common for gypsum wallboard or sheetrock to be nailed in place on wooden studs by hand using a conventional hammer having a rounded head. The head of the nail must be driven far enough inwardly with respect to the paper surface to create a slight indentation herein known as a dimple. The dimple provides a recess for holding a compound which completely covers and conceals the nail head. This covering provides a smooth flat surface for the application of paint or wallpaper.

The above dimpling action requires a great deal of precision by a worker. Sheetrock is fastened to the studs by means of special nails having a slightly cupped head and a tapered underneath side. The shape of the nail requires the use of a concave hammer head. A flat headed nail would break the outer paper surface of the sheetrock as would driving a nail too far inwardly.

It is common in the prior art to provide various types of attachments for use with penumatic hammer operator to drive nails into sheetrock. Heretofore, the stroke could not be regulated so there was often a tendency to break the outer paper surface. Also, the dimpling effect of various attachments is often inconsistent.

A preliminary search was conducted and the following prior art patents were uncovered: U.S. Pat. Nos. 4,341,336, 3,774,293, 2,918,675, 3,765,588, 3,027,560, 4,313,552, and 3,040,327.

An improved dimpler attachment is disclosed in U.S. Pat. No. 4,341,336 to Smith. The dimpler attachment comprises a rounded head having a central channel and an elongated driver which is received into the channel. Fasteners are fed into the channel by means of a magazine. The fastener is actually urged into the wallboard by means of an interior piston attached to the driver. The dimpling action occurs when the driver and the head are temporarily locked together.

Another patent, U.S. Pat. No. 3,765,588 to Frederickson, discloses a nail feeding apparatus which is provided with a magnet fixed to a receiver plate. The purpose of the Frederickson patent is to hold a nail in a proper position to be struck by a reciprocating plunger which acts as a hammer. This device provides no dimpling action and is not intended for use in affixing sheetrock to wooden studs.

In U.S. Pat. No. 3,774,293 to Golsch, the fastener driving tool disclosed is similar to the Smith patent. The Golsch patent also utilizes a piston driven plunger no driver to urge a nail into sheetrock. The dimpling tool in U.S. Pat. No. 3,040,327 to Michel is adapted for use with U-shaped fasteners and is somewhat cumbersome to use.

No prior art patent discloses a magnetic hammer head which provides the dimpling action itself. No prior art reference uses a plastic shield about the head to produce a consistent dimpling action from nail to nail by precise stroke length control.

SUMMARY OF THE INVENTION

It is an object of the present invention to provide a special attachment to drive nails into sheetrock by means of a conventional pneumatic hammer operator. It is a further object of this invention to provide an attachment which produces a consistent dimpling operation from nail to nail.

The present invention comprises a special attachment that is operationally connected to a conventional pneumatic hammer operator. The reciprocating action of the hammer can be actuated by various means such as a palm or trigger switch. It is intended for use with a 2400 stroke per minute streamlined hammer operator that can be essentially operated by one hand. The present invention also allows a worker to work without standing on a scaffold.

The hammer attachment of the present invention comprises a rounded forward end and an elongated shaft extending rearwardly therefrom into the barrel of a hammer. The above mentioned hammer is a conventional pneumatic type connected by means of a hose to a pneumatic power source. The hammer operator is actuated either by the palm operating switch or the pistol-like arrangement. The shaft is connected to the vibrating portion of the hammer operator in a conventional manner which provides the reciprocating action to the head.

The entire attachment is milled and composed of hardened steel with the exception of the central portion of the rounded head which has been drilled out to receive an annular insert of a non-magnetic material such as aluminum or plastic. A small cylindrical magnet is placed within the insert which acts as an insulating layer or barrier between the magnet and the steel body. It is assumed that this insulation prolongs the life of the magnet.

The hammer has a rear body portion and a forward head portion having a threaded barrel or bore which is surrounded by a smooth outer sleeve at its front end. The outer sleeve has been provided with a plexiglass shield or sheath. The shield screws into a spring which is wound about the head portion of the pneumatic hammer. The rear portion of the spring is provided with an adjustment nut threadly connected to the barrel which controls the length of the stroke. This rotatable nut provides for variable length allowing for the hammer's use with various sheetrock depths.

A sheetrock nail, having a cupped head, is placed on the hammer head over the magnet. The operator positions the hammer directly adjacent the sheetrock so that the forward end of the shield squares the tool up to the wall surface. The clear plexiglass provides a means whereby the operator ascertains and/or adjusts the exact position of the nail. He then depresses the switch to activate the hammer driving the head forward and the nail into the sheetrock.

As the nail is driven into the sheetrock, the shield moves relative to the hammer head while a steady firm pressure from the operator and the spring serve to keep the shield against the paper surface. This provides the apparent motion that the hammer head is reciprocating while the shield remains stationary. The operator can observe through the shield to note when the nail has been properly driven to the correct dimpling condition; although, unless the adjustment nut is improperly set, it is virtually impossible to break the paper of the sheetrock.

DETAILED DESCRIPTION OF THE PREFERRED EMBODIMENTS

Figure 1:
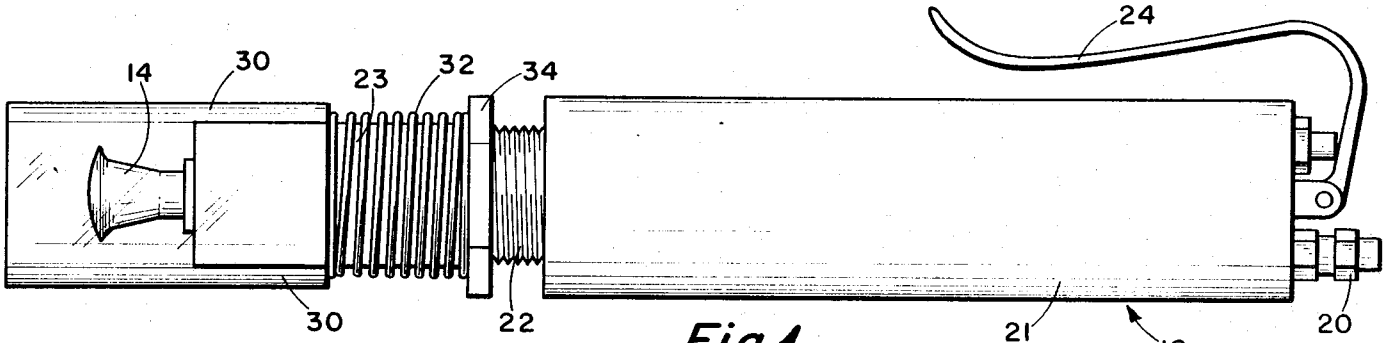
FIG. 1 is a side elevational view of the present invention as shown attached to a conventional pneumatic hammer.
Figure 2:
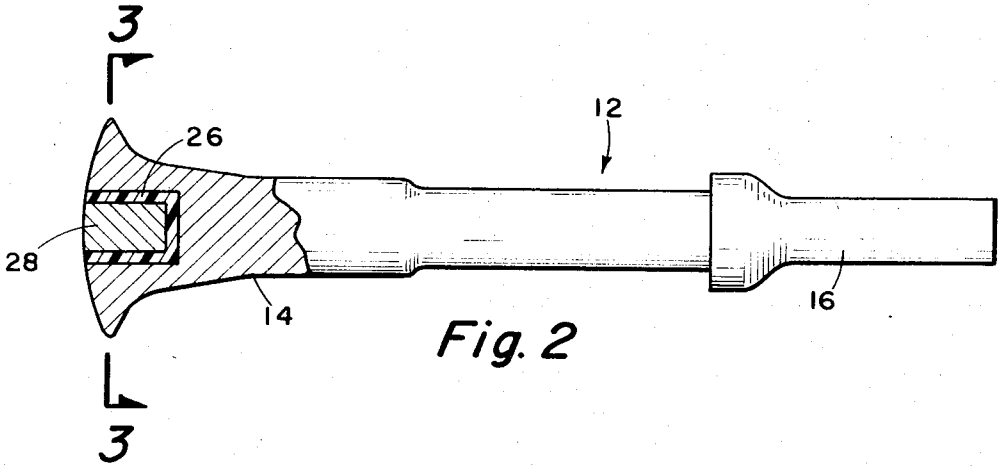
FIG. 2 is a side elevational view of the hammer attachment of the present invention with the head portion being shown in cross-section.
Figure 3:
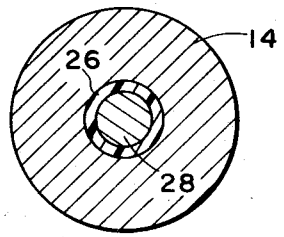
FIG. 3 is a cross-sectional view taken along section line 3—3 of FIG. 2.
Figure 4:
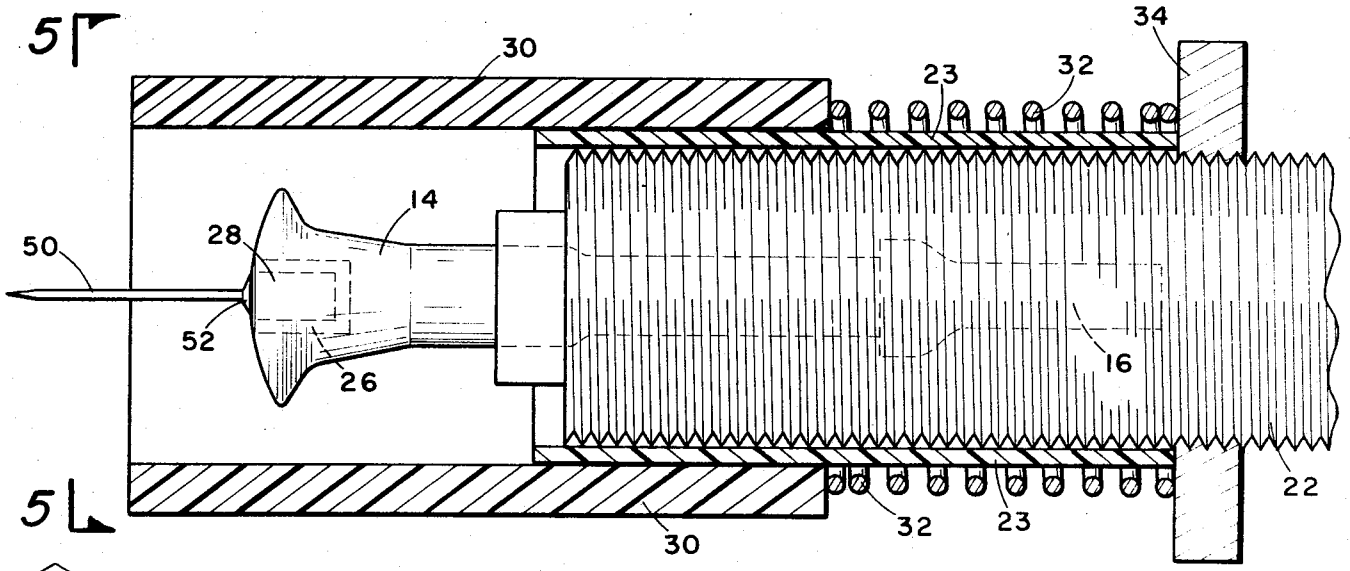
FIG. 4 is an enlarged side elevational view of the forward portion of FIG. 1 shown in partial cross-section.
Figure 5:
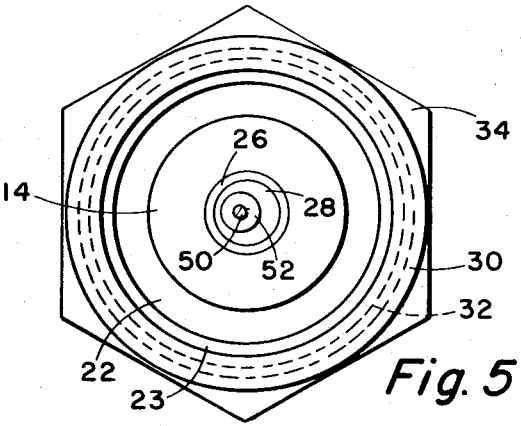
FIG. 5 is a cross-sectional view taken along section line 5—5 of FIG. 4.

Referring to FIGS. 1 through 5, the sheetrock hammer attachment 12 of the present invention is composed of milled hardened steel comprising a rounded forward end or head 14 and an elongated shaft 16 extending rearwardly therefrom. The present invention is employed with a conventional pneumatic hammer operator 18 which is connected to a pneumatic power source (not shown) at a hose connection 20 on the rear body portion 21 of hammer operator 18. As best shown in FIG. 4, shaft 16 is received into a forward barrel or bore 22 of hammer operator 18 and connects with the vibrating portion of the same in a conventional manner. Bore 22 is threaded and is provided with a smooth outer sleeve 23 surrounding its forward end. The hammer operator is actuated by means of a palm operating switch 24 (see FIG. 1), although the actuating means or hammer configuration is not limited thereto.

Referring now to FIGS. 2 and 3, the center portion of rounded head 14 has been drilled out to provide for an annular insert 26 which is composed of a non-magnetic material such as plastic or aluminum. A small cylindrical magnet 28 is tightly received in insert 26. The insert serves as an insulating layer between 28 and the steel body of head 14 and is therefore assumed to prolong the life of the magnet.

As shown, the present invention also comprises a clear plexiglass shield or sheath 30 surrounding the front portion of sleeve 23 and extending forwardly therefrom. The shield is rotatably affixed to a spring 32 which is wound about the rear portion of sleeve 23. The rear portion of spring 32 is adjacent an adjustment nut 34 which is threadably connected to bore 22. The length of the stroke is adjusted by rotating the nut 34 forward to shorten the stroke or rearward to lengthen the stroke.

Figure 6:
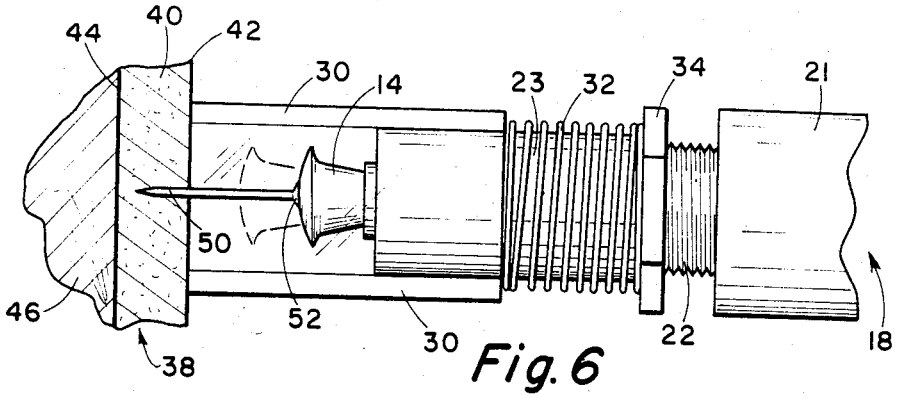
FIG. 6 is a side elevational view showing the initial step of operation of the present invention.
Figure 7:
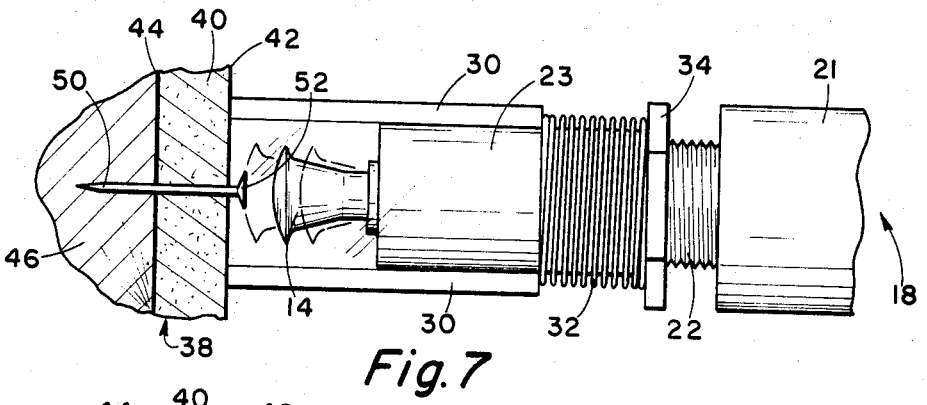
FIG. 7 is the next step in operation as follows FIG. 6.
Figure 8:
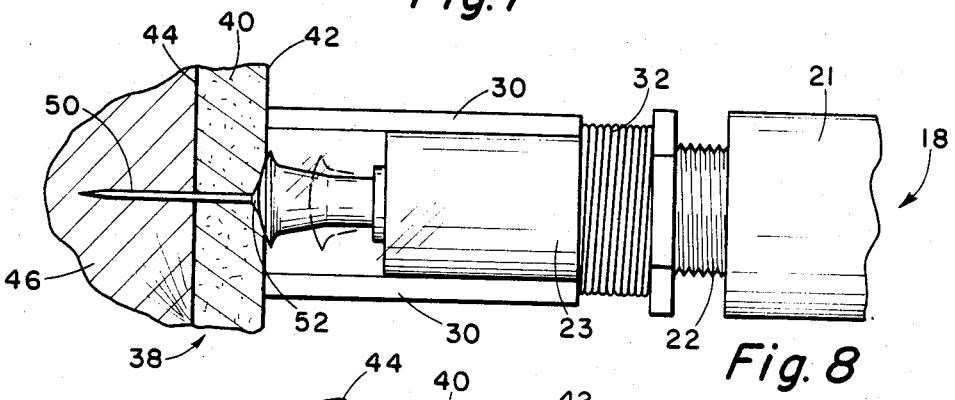
FIG. 8 is the final step in operation following FIG. 7 showing a nail completely driven into a stud.

The operation of the present invention is shown in the dotted lines of FIGS. 6, 7 and 8. Sheetrock, for example, is composed of a gypsum interior layer 40 covered by a forward paper layer 32 and a rear paper layer 44. The sheetrock 38 is to be secured to a wooden stud 46. A sheetrock nail 50, having a cupped head 52, is positioned by hand on head 14 over magnet 28 (see FIGS. 4 and 5).

Figure 9:
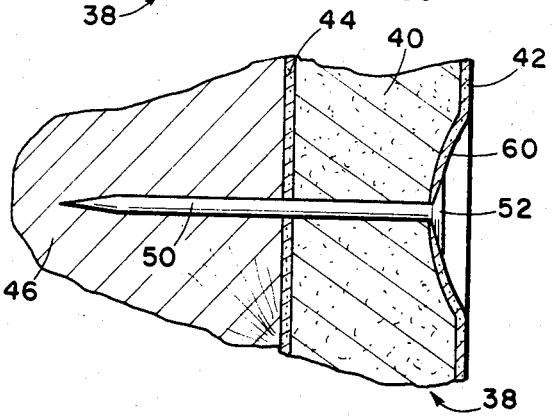
FIG. 9 is a enlarged cross-sectional view of the finished effect of the present invention.

Referring to FIGS. 6, 7 and 8, the operator positions the hammer adjacent the sheetrock and viewing the nail 50 through shield 30 places it over the exact spot where it is to be driven. He depresses switch 24 to drive the hammer head 14 forward and the nail 50 into the sheetrock 38. As shown in the drawings, spring 32 compresses as the shield 30 reciprocates relative to the head 14. However, firm pressure is maintained by means of spring 32 and the operator thus maintaining the forward end of the shield against the front paper 42. This provides the apparent action of head 14 reciprocating inwardly while shield 30 remains stationary. The operator can view through the plexiglass shield to determine when the nail has been driven to the proper dimpling condition (see FIG. 9). Correct setting of the adjustment nut 34 provides a constant stroke length from nail to nail and a consistent dimple 60. Unless nut 34 has been improperly set it is essentially impossible to break paper 42. Afterwards, dimple 60 will be filled with a type of compound which covers nail head 52 completely and provides a smooth flat surface.

What is claimed is:

1. A sheetrock hammer attachment for use with a pneumatic power hammer operator of the type having a rear body portion and a forward body portion wherein said forward portion comprises a cylindrical threaded bore and a smooth outer sleeve covering the front end of said bore, and an actuating means wherein depressing said actuating means provides a vibrating action to a hammer received in said bore; comprising a hardened steel hammer having a rounded forward head and an elongated shaft extending rearwardly therefrom, said elongated shaft being received in said bore and being operationally connected thereto, a central portion of said head being drilled away to provide a cylindrical hole, a smaller cylindrical magnet for holding the head of a nail being received in said hole, an insulating means received in said hole between said magnet and said head for retaining said magnet in said hole, a tension spring being wound about a portion of said outer sleeve, a clear shield covering the front end of said sleeve and extending forwardly therefrom, the forward end of said shield directly adjacent a panel of sheetrock, said shield being rotatably affixed to the forward end of said spring, and an adjustment means adjacent the rear portion of said spring, for controlling the length of said spring, wherein depressing said actuating means vibrates said hammer causing said shield to reciprocate rearward while compressing said spring and moving said head forward thereby driving said nail into a panel of sheetrock.

2. A sheetrock hammer attachment as set forth in claim 1 wherein said insulating means comprises an annular insert of non magnetic material.

3. A sheetrock hammer attachment as set forth in claim 2 and being further characterized by said non-magnetic material being aluminum.

4. A sheetrock hammer attachment as set forth in claim 1 wherein said adjustment means comprises a rotatable nut threadedly connected to said bore.

5. A sheetrock hammer attachment as set forth in claim 4 and being further characterized by rotating said nut about said bore forward relative said shield decreases the length said shield reciprocates and rotating said nut rearward relative said shield increases the length said shield reciprocates thereby providing a consistent stroke length.

* * * * *